US008997896B2

(12) United States Patent
Clark et al.

(10) Patent No.: US 8,997,896 B2
(45) Date of Patent: Apr. 7, 2015

(54) OIL-BASED DRILLING FLUID RECOVERY AND REUSE

(75) Inventors: David E. Clark, Humble, TX (US); Lirio Quintero, Houston, TX (US); Anuradee Witthayapanyanon, The Woodlands, TX (US); Alexander John McKellar, The Woodlands, TX (US); Martin Gilbert, Scotland (GB)

(73) Assignee: Baker Hughes Incorporated, Houston, TX (US)

( * ) Notice: Subject to any disclaimer, the term of this patent is extended or adjusted under 35 U.S.C. 154(b) by 476 days.

(21) Appl. No.: 13/039,045

(22) Filed: Mar. 2, 2011

(65) Prior Publication Data

US 2011/0220418 A1 Sep. 15, 2011

Related U.S. Application Data

(60) Provisional application No. 61/312,739, filed on Mar. 11, 2010.

(51) Int. Cl.
*E21B 21/06* (2006.01)

(52) U.S. Cl.
CPC ..... *E21B 21/068* (2013.01)

(58) Field of Classification Search
CPC .... B01D 17/047; B01D 21/01; B01D 17/045; C10G 33/04; C10G 2300/1033; C09K 8/885; C09K 8/502; C09K 8/504; E21B 43/36; E21B 43/34; E21B 43/38; E21B 21/068
See application file for complete search history.

(56) References Cited

U.S. PATENT DOCUMENTS

| | | | | |
|---|---|---|---|---|
| 5,234,577 | A * | 8/1993 | Van Slyke | 208/13 |
| 5,271,841 | A | 12/1993 | Hart | |
| 5,882,524 | A | 3/1999 | Storey et al. | |
| 6,132,630 | A | 10/2000 | Briant et al. | |
| 6,177,014 | B1 | 1/2001 | Potter et al. | |
| 6,214,236 | B1 * | 4/2001 | Scalliet | 210/708 |
| 6,711,830 | B2 | 3/2004 | Hensley et al. | |
| 6,977,048 | B2 | 12/2005 | Mueller et al. | |
| 7,247,604 | B2 * | 7/2007 | Dalmazzone et al. | 507/131 |
| 7,300,578 | B2 | 11/2007 | Mueller | |
| 7,497,954 | B2 | 3/2009 | Ivan et al. | |
| 7,507,344 | B2 | 3/2009 | Mueller | |
| 7,514,005 | B2 | 4/2009 | Browne et al. | |
| 7,754,661 | B2 | 7/2010 | Smith et al. | |
| 7,935,261 | B2 | 5/2011 | Jones et al. | |
| 2005/0202978 | A1 * | 9/2005 | Shumway | 507/203 |
| 2006/0163177 | A1 * | 7/2006 | Johnson et al. | 210/799 |
| 2007/0056740 | A1 | 3/2007 | Hollier | |
| 2007/0131454 | A1 | 6/2007 | Hollier et al. | |
| 2007/0170118 | A1 * | 7/2007 | Browne et al. | 210/708 |
| 2009/0166028 | A1 * | 7/2009 | Varadaraj et al. | 166/244.1 |
| 2009/0200213 | A1 * | 8/2009 | Varadaraj et al. | 209/5 |

OTHER PUBLICATIONS

Childs, Jeffrey D., "Surfactant Enhanced Treatment of Oil Based Drill Cuttings," Journal of Energy Resources Technology, Jun. 2005 vol. 127; pp. 153-162.

* cited by examiner

*Primary Examiner* — Zakiya W Bates
(74) *Attorney, Agent, or Firm* — Mossman, Kumar & Tyler, PC

(57) ABSTRACT

Methods and related systems are configured to treat a drilling fluid to cause water droplets to coalesce. One or more phases are thereafter separated from the treated drilling fluid. The oil and/or solids separated from the treated drilling fluid may be added to a base fluid.

32 Claims, 7 Drawing Sheets

| | DOBM | INITIAL OWR | FINAL OWR |
|---|---|---|---|
| 108 | FIELD MUD | 73/27 | 97/3 |
| 110 | FIELD MUD (DILUTED) | 60/40 | 95/5 |

| | |
|---|---|
| MUD WEIGHT, LB/GAL | 10 |
| OWR | 72/28 |
| % OIL | 62 |
| % WATER | 24 |
| % SOLIDS | 14 |

120

FIG. 5

122

| PROPERTIES | FLUID FORMULATED FROM RECOVERED OIL |
|---|---|
| MUD WEIGHT, PPG | 10.6 |
| TYPE OF BASED OIL | DIESEL |
| ELECTRICAL STABILITY, VOLTS | 1241 |
| HPHT FLUID LOSS @ 250F | 3.0 |
| RHEOLOGICAL PROPERTIES @ 120°F | |
| 6 RPM/3 RPM | 13/12 |
| PLASTIC VISCOSITY, cP | 25 |
| YIELD POINT, LB/100 SQ FT | 25 |
| 10-SEC / 10-MIN GEL, LB/100 SQ FT | 13/17 |

FIG. 6

132

| FLUID PROPERTIES | DOBM LAB MADE WITH 90/10 OWR | | |
|---|---|---|---|
| | 100% MIL BAR | 80/20 MIL-BAR-TO-RESIDUAL SOLIDS | 60/40 MIL-BAR-TO-RESIDUAL SOLIDS |
| MUD WEIGHT, PPG | 10.07 | 10.01 | 10.00 |
| ES, VOLTS | 841 | 727 | 759 |
| HPHT FLUID LOSS @ 250°F | 7.5 | 7.0 | 8.0 |
| RHEOLOGICAL PROPERTIES @ 120°F | | | |
| 6 RPM/3 RPM | 4/3 | 3/3 | 3/3 |
| PV, CP | 16 | 15 | 19 |
| YP, LB/100 SQ FT | 10 | 8 | 2 |
| 10-SEC GET, LB/100 SQ FT | 6 | 6 | 3 |

134 136 138 140

FIG. 10

OIL-BASED DRILLING FLUID RECOVERY AND REUSE

CROSS-REFERENCE TO RELATED APPLICATIONS

This application claims priority from U.S. Provisional Patent Application Ser. No. 61/312,739 filed Mar. 11, 2010, the disclosure of which is incorporated herein by reference in its entirety.

FIELD OF THE DISCLOSURE

This disclosure is directed to a method of solid-liquid-liquid separation of oil-based muds.

BACKGROUND OF THE DISCLOSURE

Oil-based muds form a general class of materials that minimally comprise a mixture of particulate solids in a hydrocarbon fluid. A subset of oil-based muds is oil-based drilling muds that contain functional additives used to improve drilling operations in several ways. These fluids are circulated through and around the drill bit to lubricate and cool the bit, provide suspension to help support the weight of the drill pipe and casing, coat the wellbore surface to prevent caving in and weight to balance against undesirable fluid flow from the formation, and to carry drill cuttings away from the bit to the surface. Such oil-based drilling fluids are oil-continuous compositions that may also contain an water solution (e.g. calcium chloride brine) as a discontinuous phase (making the fluids water-in-oil invert emulsions), emulsifiers to stabilize the invert emulsion, rheology modifying agents (e.g. oleophilic clays), weighting agents (e.g. barium sulfate), fluid loss control agents (e.g. lignins), and other additives (e.g. lime). Oil-based muds are water-in-oil macroemulsions, which are also called invert emulsions. Used oil-based drilling muds will contain, in addition to the above components, drill cuttings and other dissolved or dispersed materials derived from the drilled medium or from other sources of contamination such as process and environmental waters. With high levels of contamination, oil-based drilling muds lose their desirable fluid properties and performance. As a consequence, contaminated oil-based muds must be discarded or reconditioned.

The present disclosure addresses the reclamation and recycling of such fluids.

SUMMARY OF THE DISCLOSURE

In one aspect, the present disclosure provides a method for treating a drilling fluid. The method may include treating the drilling fluid to cause water droplets to coalesce; and separating at least one phase from the treated drilling fluid.

In another aspect, the present disclosure provides a system for treating a drilling fluid. The system may include a structure for receiving the drilling fluid; a source supplying a water droplet coalescing agent to the fluid in the structure; and a separator configured to receive the drilling fluid from the structure. The structure may be a tank or a fluid conduit such as a pipe.

In yet another aspect, the present disclosure provides a method of forming a drilling fluid. The method may include adding to a base fluid at least one of: (i) an oil phase recovered from a treated drilling fluid, and/or (ii) a functional solid material recovered from a treated drilling fluid, and/or (iii) the recovered water component from the treated drilling fluid.

Examples of certain features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE FIGURES

For detailed understanding of the present disclosure, reference should be made to the following detailed description of the preferred embodiment, taken in conjunction with the accompanying drawing:

FIG. 5 shows selected properties of a drilling mud without treatment;

FIG. 6 shows selected properties of a drilling mud after being treated according to embodiments of the present disclosure;

FIG. 10 shows selected properties of a drilling mud formulated with solids phase recovered from a drilling fluid treated according to embodiments of the present disclosure.

DETAILED DESCRIPTION OF THE DISCLOSURE

The present disclosure related to methods and devices for processing a recovered invert emulsion drilling mud in a manner that allows the recovery of economically valuable components of such drilling mud. The present disclosure is susceptible to embodiments of different forms. The drawings show and the written specification describes specific embodiments of the present disclosure with the understanding that the present disclosure is to be considered an exemplification of the principles of the disclosure, and is not intended to limit the disclosure to that illustrated and described herein.

Illustrative embodiments of the present disclosure may be used to recover a base fluid, such as diesel or other oil, from a drilling fluid. As used herein, the term 'drilling fluid' refers generally to a class of fluids used during wellbore drilling. Thereafter, the recovered base fluid may be used to formulate new drilling fluid. In certain embodiments, the recovered invert emulsion drilling fluid is subjected to a chemical treatment and a mechanical treatment. An exemplary chemical treatment may involve, one or more additives, such as a demulsifier, being added to an oil-based mud having brine. The chemical treatment destabilizes the emulsions in the drilling fluid to allow water droplets to coalesce. In embodiments, destabilizing the emulsion of the treated drilling fluid does not substantially impair the functionality of the emulsifiers. Thus, the recovered oil, and/or solids, and/or water solution may be re-used to formulate new drilling mud with limited, if any, additional processing. For example, because the emulsifiers are not substantially degraded, the additional processing may involve either adding no additional emulsifiers or adding a limited amount of additional emulsifiers to that already present in the treated drilling mud. The mechanical treatment may include mixing the additive(s) with the oil-based mud and then processing the oil-based mud using one or more separators.

Figure 1:
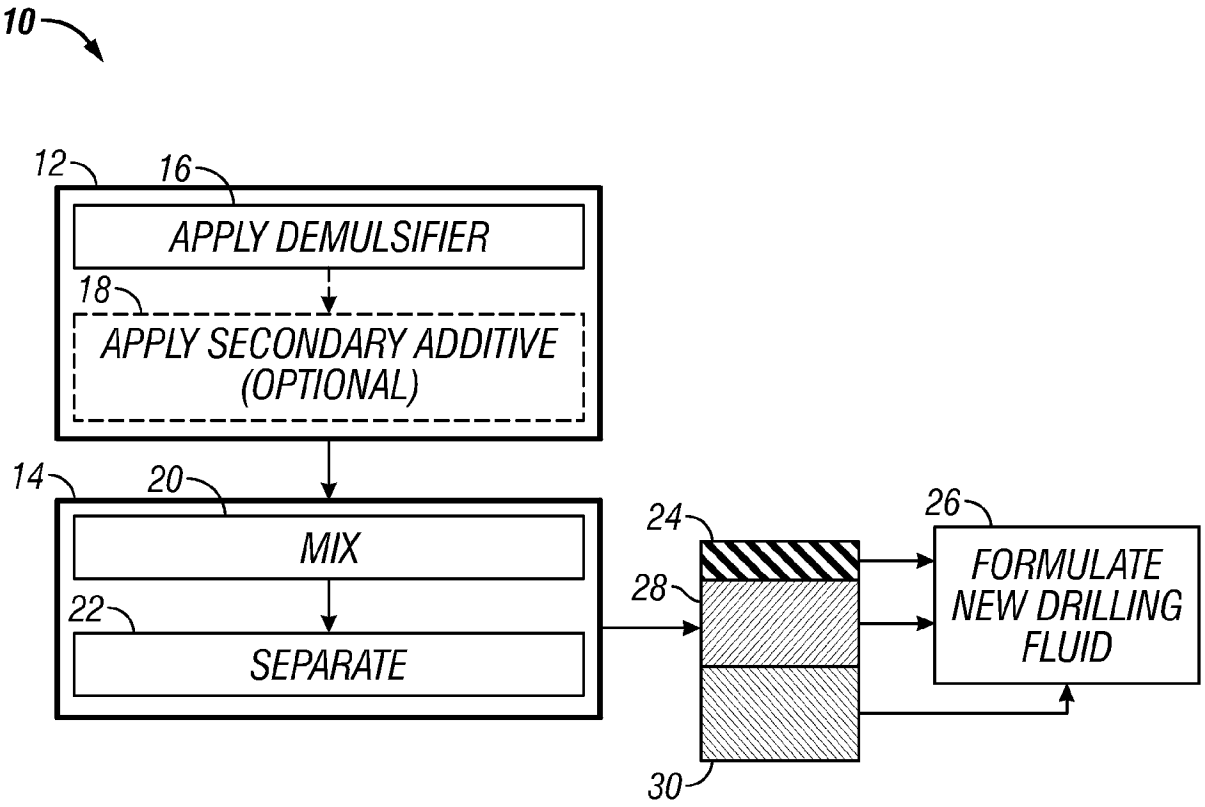
FIG. 1 illustrates a flow chart showing one illustrative treatment method of the present disclosure.

Referring now to FIG. 1, there is shown a flow chart having a drilling fluid processing method 10 according to one embodiment of the present disclosure. The method may include a chemical treatment 12 and a mechanical treatment 14. The chemical treatment 12 may be formulated to destabilize the treated invert emulsion drilling fluid such that water droplets and colloidal solids in the treated invert emulsion drilling fluid may freely coalesce. It should be appreciated that the chemical treatment 12 causes the water droplets to coalesce, rather than the coalescence being a by-product of the treatment. For example, the destabilizing may be performed by displacing mud emulsifier(s) from the recovered invert emulsion drilling fluid by other surface-active agents. In one embodiment, the chemical treatment 12 may use one or more additives, e.g., a demulsifier(s) 16 and, optionally, a secondary additive 18.

In some non-limiting embodiments, the optional secondary additive 18 may be a surface active agent or surfactant. In certain particular embodiments, the combination of particular demulsifiers and particular surfactants may cause undesirable precipitation. In some of these cases, precipitation may be avoided or largely prevented by a particular order of addition, including, but not necessarily limited to, adding and mixing in the demulsifier first and subsequently adding and mixing in the optional surfactant. It should be understood, however, that the sequence in which the demulsifier and the secondary additive are added, the type of additive(s) used, and the concentration of the additive(s) may vary according to the composition of the recovered invert emulsion drilling fluid. In certain embodiments, an acid treatment may be excluded from the chemical treatment 12. In some non-limiting applications, the chemical treatment 12 may be acid-free.

Suitable demulsifiers include, but are not limited to, those which contain functional groups such as ethers, amines, ethoxylates, propoxylates, phosphate, sulfonates, sulfosuccinates, carboxylates, esters, glucoside, amides, mutual solvents and mixtures thereof. For certain applications, the chemical treatment 12 may utilize Baker Hughes Incorporated demulsifier 16 DFE 760 or DFE 790. Other examples of demulsifiers include SUPSOL and DISSOL 4411-1C, also available from Baker Hughes Incorporated. The proportion of demulsifier may be from about 0.5 independently to about 6 vol % and the proportion of surfactant may be from about 0.5 independently to about 5 vol %, where "independently" means that any lower threshold may be used together with any upper threshold.

Suitable anionic surfactants selected from the group consisting of alkali metal alkyl sulfates, alkyl ether sulfonates, alkyl sulfonates, alkyl aryl sulfonates, linear and branched alkyl ether sulfates and sulfonates, alcohol polypropoxylated sulfates, alcohol polyethoxylated sulfates, alcohol polypropoxylated polyethoxylated sulfates, alkyl disulfonates, alkylaryl disulfonates, alkyl disulfates, alkyl sulfosuccinates, alkyl ether sulfates, linear and branched ether sulfates, alkali metal carboxylates, fatty acid carboxylates, and phosphate esters; suitable cationic surfactants include, but are not necessarily limited to, arginine methyl esters, alkanolamines and alkylenediamides. Suitable surfactants may also include surfactants containing a non-ionic spacer-arm central extension and an ionic or nonionic polar group. Other suitable surfactants are dimeric or gemini surfactants and cleavable surfactants. In certain applications, NaOH may be used to improve the efficiency of the additives. Baker Hughes Incorporated surfactant DFE 755, for the surfactant 18. As noted previously, the addition of the surfactant is optional. Exemplary percentage ranges for such additives may include from about 0.5 to about 6 vol % demulsifier (e.g. DFE 760, DFE 790) and from about 0.5 to about 5 vol % surfactant (e.g. DFE 755). Other surfactant examples include Baker Hughes Incorporated surfactants EXP 206, EXP 219, and EXP 325. Suitable surfactants include, but are not limited to, anionic, nonionic, cationic, amphoteric, extended surfactants and blends thereof. Still other suitable nonionic surfactants include, but are not necessarily limited to, alkyl polyglycosides, sorbitan esters, methyl glucoside esters, amine ethoxylates, diamine ethoxylates, polyglycerol esters, alkyl ethoxylates, alcohols that have been polypropoxylated and/or polyethoxylated or both.

After the additives are applied to the recovered invert emulsion drilling fluid, the recovered invert emulsion drilling fluid is mixed 20. The treated drilling fluid may be mixed within the holding tank in which the additive(s) are applied. The treated drilling fluid may also be mixed while being pumped or otherwise conveyed via a conduit by a separate in line mixer in a continuous process. For example, the demulsifier and a secondary additive (e.g., surfactant), if present, may be mixed in a feed pipe to the separator. The duration of the mixing may be selected to provide a desired oil-water ratio. It should be appreciated, however, that the mixing 20 may be performed while one or more of the additives are applied to the recovered invert emulsion drilling fluid. After mixing, the components making up the recovered invert emulsion drilling fluid are separated 22. In applications, the separation is a three-phase separation; i.e., oil, water, and solids. The light liquid oil phase 24, which may include some small proportion of water, may be thereafter used to formulate new drilling fluid 26. The heavy liquid water phase 28, which may include some small proportion of oil, may thereafter be treated to remove the oil content to meet local discharge or reuse requirements. The solids phase 30, which may include functional materials (e.g., weighting material as barite), may also be used to formulate a new drilling fluid 26. As used herein, the term "functional material" is any material that is included in a mixture to perform a specific task when the mixture is used (e.g., control density, cause emulsification, vary viscosity, etc.). It should be understood that the oil 24, and/or the solids 30, and/or the water phase 28 need be used to formulate a new drilling fluid. That is, these phases may be recovered and used as needed. In certain embodiments, other components, such as a thin layer of solids suspended invert emulsion phase may also be present.

Figure 2:
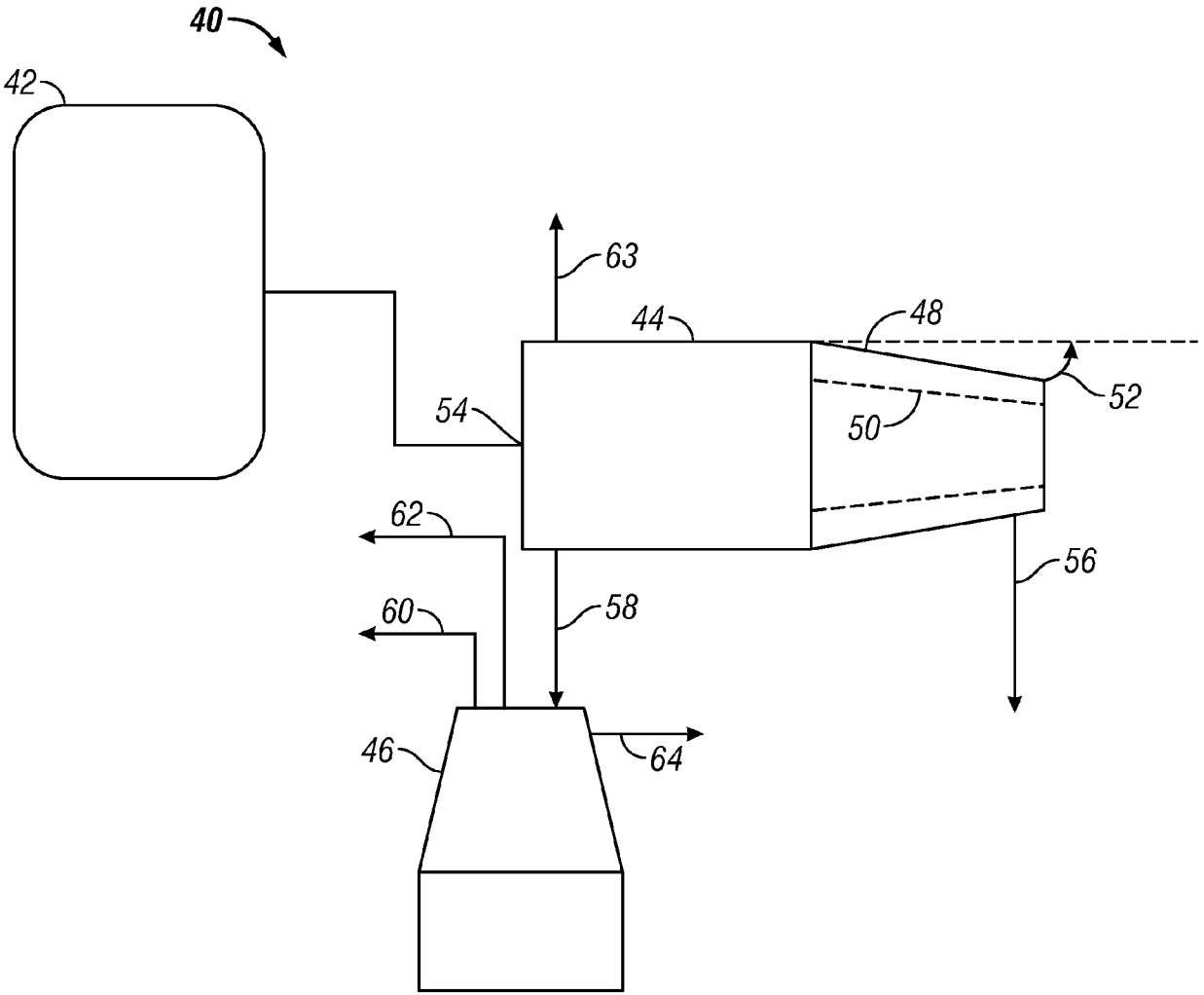
FIG. 2 schematically illustrates a treatment system in accordance with one embodiment of the present disclosure.

Referring now to FIG. 2, there is shown a system 40 for processing a recovered fluid according to one embodiment of the present disclosure. The system 40 may include a tank 42 in which the recovered invert emulsion drilling fluid is treated and one or more separators 44, 46. The tank 42 may be configured to allow manual and/or automated delivery of one or more agents concurrently or sequentially into the tank 42. The tank 42 may also include suitable mechanisms, such as agitators, that can be activated to mix the fluids in the tank 42. In other embodiments, the recovered invert emulsion drilling fluid may flow through a conduit while being treated. For instance, the pipe may include an in-line mixer (not shown) to mix the drilling fluid. Thus, the tank 42 is only one non-limiting example of a structure suitable for receiving and treating the recovered invert emulsion drilling fluid. After being chemically treated in the tank 42 or in a conduit, the recovered invert emulsion drilling fluid is conveyed to a first separator 44. A fluid conveyance device such as a progressive cavity pump (not shown) may be used to pump the recovered fluid. Illustrative, but not exhaustive separators, include cyclone separators, centrifuges, separation disc type decanter centrifuges, vane decanters, decanters, dehydrators, etc. In one embodiment, the separator 44 is a decanter separator that includes a screw conveyor 48, a portion of which is in a beach zone 50. The screw conveyor 48 may use a beach angle 52 that may be less than ten degrees, e.g., three to six degrees. The separator 44 may receive the recovered invert emulsion drilling fluid at an inlet 54 and may discharge solids at a first outlet 56 and the light phase liquids (oil) at a second outlet 58. Heavy phase liquids (water) may be discharged from the third outlet 63. The outlet 58 may direct the liquid to the second separator 46. In one embodiment, the second separator 46 may be a disc stack centrifuge. The second separator 46 discharges solids 60 and a light phase liquid 62 and a heavy phase liquid 64.

In one test using a non-limiting method according to one embodiment of the present disclosure, a contaminated drilling fluid with low initial oil-water ratio was mixed in a holding tank. Next, a demulsifier and a surfactant, both of which were optional, were added into the contaminated drilling fluid. The duration of the mixing was selected based on the initial oil-water ratio of contaminated drilling fluid and final desired oil-water ratio of base fluid to be recovered. The treated drilling fluid was continuously pumped into a centrifuge to enhance the separation. As shown in FIG. 1, the centrifuge separated the drilling fluid into three main phases, i.e., light liquid oil 26, water 28 and solids 30. As used herein, the term phase refers to material make-up as opposed to material state (e.g., solid, liquid, gas). The light liquid oil phase typically achieved a relatively high oil/water ratio e.g., greater than 80 vol %, alternatively, greater than 90 vol %, or greater than 95 vol %, or even greater than 98 vol %.

In the sections that follow, tests based on illustrative methods according to the present disclosure will be discussed. It is emphasized, however, that the methods, devices and systems of the present disclosure are not limited to those tested. Rather, these tests and test results are provided merely to further describe the teachings of the present disclosure.

Generally, the tests used an oil-based drilling mud recovered (recovered drilling mud) from a conventional drilling operation. The recovered drilling mud was treated in the laboratory with demulsifier and surfactant and then placed in a laboratory centrifuge at 2600 rpm for 20 minutes. During testing, the additives were added in sequence and separately: first the DFE-790 demulsifier and then the DFE 755 surfactant solution.

In this testing, the recovered drilling mud was a diesel oil-based drilling mud having an initial oil-water ratio (OWR) of 73/27. A base treatment formulation consisted of 4% vol DFE-790 demulsifier and 3% vol surfactant DFE 755. The treatment concentration was varied from dilute concentration of 0.5% vol to 12% vol while maintaining the % vol ratio of the base treatment formulation. As used herein, the treatment concentration is the combined % vol of the demulsifier and surfactant.

Based on the laboratory results, it is believed that an OWR of 90/10 or greater of the recovered drilling mud may be achieved by using as little as 0.5% total chemical treatment concentration.

Figures 3, 4:
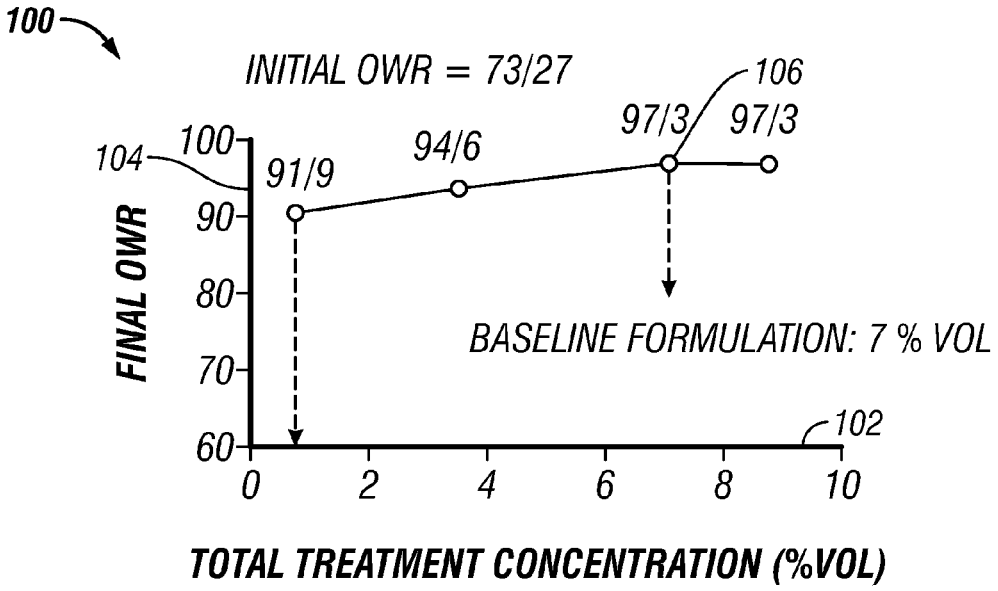
FIGS. 3 and 4 shows initial and final OWR values for drilling mud treated according to embodiments of the present disclosure.

FIG. 3 shows the results of tests performed on samples of recovered drilling mud that had an initial OWR of 73/27. In the graph 100, values for total treatment concentration (% vol) lie along the x-axis 102 and values for final OWR lie along the y-axis 104. The maximum final OWR of 97/3 for the recovered drilling mud was observed at 7% vol total treatment (4% vol DFE-790 demulsifier and 3% vol surfactant DFE 755) as shown at point 106. Further increase in the treatment concentration was not observed to improve the OWR of the recovered drilling mud.

Also evaluated was the performance of the treatment package with a recovered oil-based drilling mud with a lower initial OWR of 60/40. FIG. 4 shows initial and final OWR values for two field muds 108, 110 treated with 4% vol DFE-790 demulsifier and 3% vol surfactant DFE 755. The field mud 110 was diluted to decrease the initial OWR. As shown, both samples 108, 110 of recovered diesel oil-based mud exhibited a significant increase in the OWR. Thus, it is believed that, based on these results, that the same demulsifier/surfactant formulation of 7% vol total treatment can achieve a desirable final OWR for drilling mud having a wide range of initial OWR ratios.

As described previously, recovered oil obtained from the reclaimed process may be used to formulate new oil-based muds. Discussed below are tests involving recovered components (e.g., oil and solids) that were used to formulate oil-based mud with selected properties suitable for drilling operations. These tests were performed using a conventional field diesel oil-based drilling mud. The values of selected properties of the oil-based mud prior to treatment are shown in FIG. 5.

Typically, an oil-based mud treated in a decanter centrifuge will result in the separation of an oil/water phase and a solids/oil/water phase. In a series of tests, the performance of the decanter centrifuge was evaluated by changing the mechanical parameters designed to remove water from the oil/water phase and a solids/oil/water phases. Illustrative parameters that were varied included the feed rate, beach angle, bowl speed, and pond depth. In these tests, mechanical separation was conducted using a 3-Phase decanter centrifuge. The mechanical parameters included a bowl size ~6", bowl speed of 3600 rpm, differential speed of 20 rpm, a feed tube length of 515 mm, a pond depth of 146.5 mm and a beach angle of 5 degrees. The variable operating parameters included a variable feed rate of 400 to 700 l/hr.

Favorable solid/liquid/liquid separation was indicated by the clear brine that was observed to have relatively minute contaminations of oil and solids. Samples were taken at regular intervals and analysis was performed at the site during the tests.

The recovered oil sample from the tests was used to formulate an oil-based mud using four main ingredients; (i) recovered oil having a high OWR of 95/5, (ii) untreated test mud (OWR of 73/27), (iii) viscosifying agent CARBO-GEL, and (IV) weighting agent MIL-BAR. The new oil-based mud was targeted to be 10 ppg mud and have the OWR of 90/10. Notably, in this reformulation there was no required addition of emulsifying agent to maintain a water in oil emulsion.

FIG. 6 is a table 122 that shows the values for selected properties of fluid formulated from recovered oil. The results indicate stable invert emulsion with acceptable fluid loss and rheological properties. By acceptable, it is intended that the formulated OBM should possess the characteristics suited for use in a drilling operation. Based on these results, it is feasible to reuse the recovered oil to formulate new drilling fluids with high quality recovered oil phase and minimal additional emulsifying agents.

Figure 7:
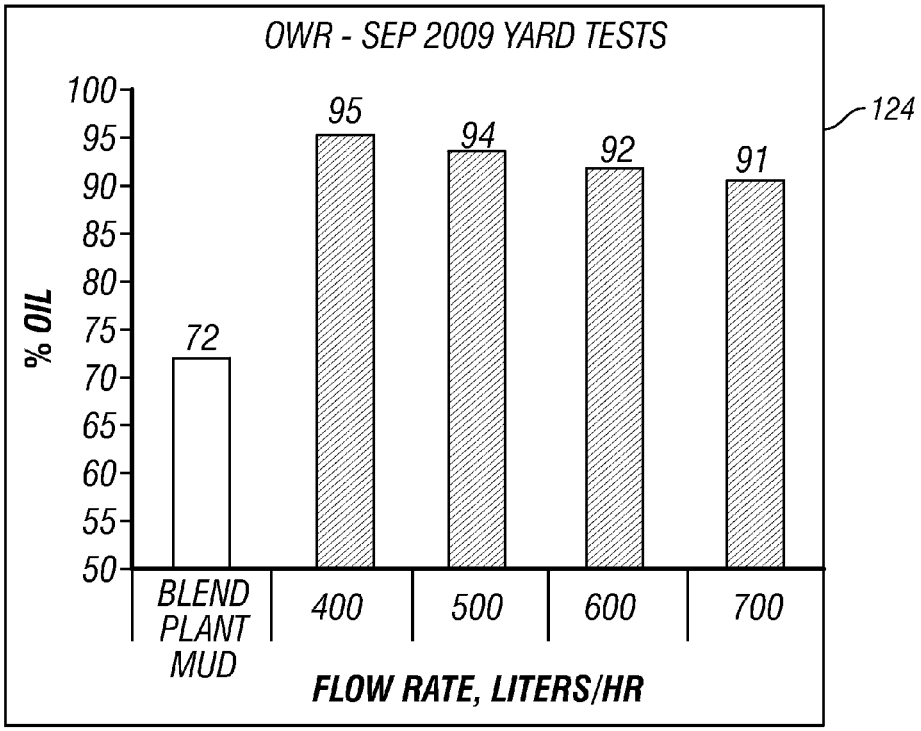
FIGS. 7-9 show test results for percent oil, percent oil phase, and percent solid phase for several feed flow rates.
Figure 8:
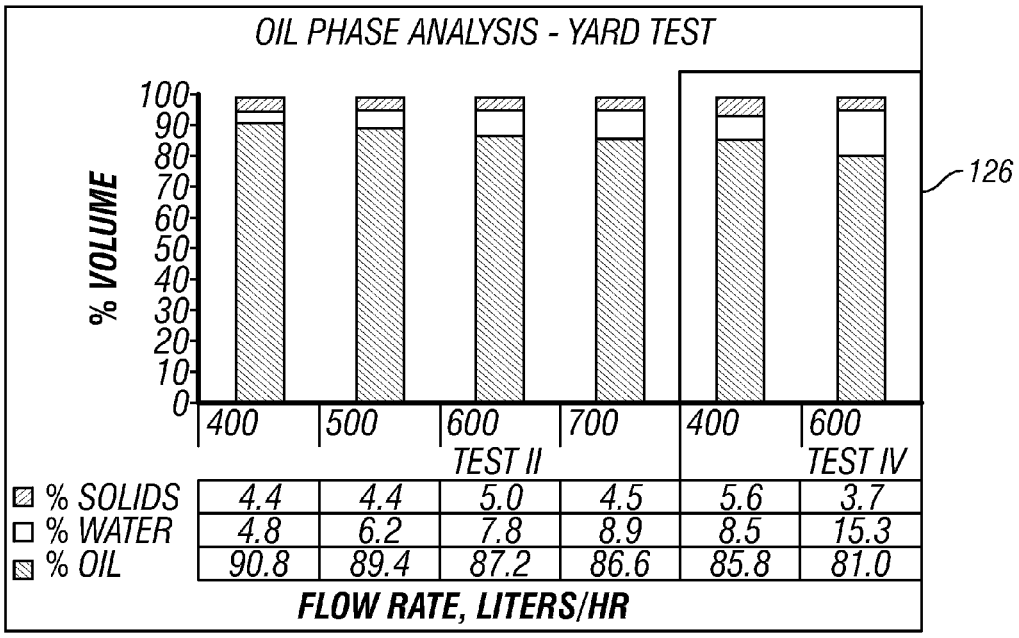
Figure 9:
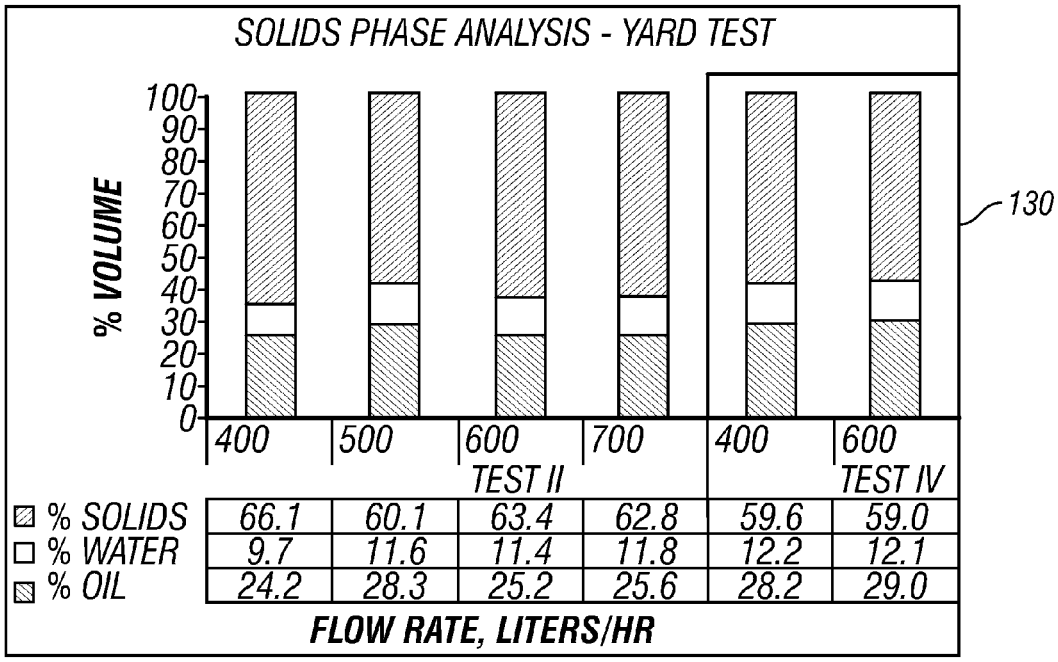

FIGS. 7-9 shows the effect of varying feed flow rate on the final achieved OWR. These tests varied the feed flow rate into the separator and were based on a recovered drilling mud having an initial OWR of 72%. FIG. 7 is a chart 124 that shows the final percentage of oil achieved for feed flow rates ranging from 400 to 700 l/hr. FIG. 8 is a chart 126 that shows the effect of varying flow rate on the recovered oil phase. The oil phase analysis showed a 4-6% reduction in solids and a 4-9% reduction in water relative to drilling mud before treatment. FIG. 9 is a chart 130 that shows the effect of varying flow rate on the recovered solids phase. The solids phase analysis showed a reduction of 24-29% in oil content and 9-12% in water content relative to drilling mud before treatment.

In the laboratory, drilling fluid was reformulated using recovered solids and compared to drilling fluid formulated with new solids, MIL-BAR, which is available from Baker Hughes Incorporated. FIG. 10 is a chart 132 that shows the results of tests performed on three samples that were made with diesel oil-based mud having a 90/10 OWR. The first column 134 shows selected fluid and rheological properties. The second column 136 shows the values for a drilling fluid that uses only "new" solids. The third column 138 shows the values for a drilling fluid formulated with 80% "new" solids and 20% recovered solids. The fourth column 140 shows the values for a drilling fluid formulated with 60 percent "new" solids and 40% recovered solids. Based on these tests, it is believed that solids recovered using processes consistent with the present disclosure may exhibit an oil-wet behavior comparable with drilling fluids made with "new" solids, or at least suitable for use in conventional drilling operations.

From the above, it should be appreciated that, in one aspect, what has been disclosed includes methods for treating a drilling fluid. The method may include treating the drilling fluid to cause water droplets to coalesce; and separating at least one phase from the treated drilling fluid. One illustrative method may include treating the drilling fluid with a demulsifier. The demulsifier may be selected from a group consisting of: ethers, amines, ethoxylates, propoxylates, phosphate, sulfonates, sulfosuccinates, carboxylates, esters, glucoside, amides and mixtures thereof. The volume percentage of demulsifier may be between approximately 0.5 to 6. Optionally, the method may include treating the drilling fluid with a secondary additive. In some embodiments, the secondary additive is a surfactant. The surfactant(s) may be selected from a group consisting of: anionic, nonionic, cationic, amphoteric, extended surfactants and blends thereof. The volume percentage of surfactant may be between approximately 0.5 to 5. The demulsifier and the surfactant may be applied sequentially to the drilling fluid. The separated phase (s) may be one or more of: (i) a majority oil phase, (ii) a majority water phase, and (ii) a majority solid phase.

From the above, it should be appreciated that, in one aspect, what has been disclosed includes a system for treating a drilling fluid. The system may include a tank receiving the drilling fluid; a source supplying a water droplet coalescing agent to the tank; and a separator configured to receive the drilling fluid from the tank. This system may also be configured to continuously feed the treated drilling fluid from a pipe or other fluid conveying structure that includes a mixing device that can mix the treated fluid in the pipe.

From the above, it should be appreciated that, in one aspect, what has been disclosed includes a method of forming a drilling fluid. The method may include adding to a base fluid at least one of: (i) an oil phase recovered from a treated drilling fluid, and/or (ii) a functional solid material recovered from a treated drilling fluid, and/or (iii) the recovered water component from the treated drilling fluid.

The term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water.

While the foregoing disclosure is directed to the preferred embodiments of the disclosure, various modifications will be apparent to those skilled in the art. It is intended that all variations within the scope of the appended claims be embraced by the foregoing disclosure.

What is claimed is:

1. A method for treating a drilling fluid, comprising:

determining an amount of a demulsifier needed to cause water droplets to coalesce from the drilling fluid without reducing a size of particles in the drilling fluid, wherein the drilling fluid is an invert emulsion;

treating the drilling fluid with the determined amount of demulsifier to cause the water droplets to coalesce from the drilling fluid; and separating at least one phase from the treated drilling fluid.

2. The method of claim 1 wherein the demulsifier is selected from a group consisting of: ethers, amines, ethoxylates, propoxylates, phosphate, sulfonates, sulfosuccinates, carboxylates, esters, glucoside, amides and mixtures thereof.

3. The method of claim 1 wherein the volume percentage of demulsifier is between approximately 0.5 to six.

4. The method of claim 1 further comprising treating the drilling fluid with a secondary additive.

5. The method of claim 4 wherein the secondary additive is a surfactant.

6. The method of claim 5 wherein the surfactant is selected from a group consisting of: anionic, nonionic, cationic, amphoteric, extended surfactants and blends thereof.

7. The method of claim 5 wherein the volume percentage of surfactant is between approximately 0.5 to five.

8. The method of claim 5 wherein the demulsifier and the surfactant are applied sequentially to the drilling fluid.

9. The method of claim 1 wherein the at least one separated phase is one of: (i) a majority oil phase, (ii) a majority water phase, and (iii) a majority solid phase.

10. A system for treating a drilling fluid, comprising:

a tank receiving the drilling fluid, wherein the drilling fluid is an invert emulsion;

a source configured to supply a water droplet coalescing agent to the tank, wherein the water droplet coalescing agent is a demulsifier, wherein the source is configured to supply the demulsifier in an amount determined to cause the water droplets to coalesce without reducing a size of particles in the drilling fluid; and a separator configured to receive the drilling fluid from the tank.

11. The system of claim 10 wherein the demulsifier is selected from a group consisting of: ethers, amines, ethoxylates, propoxylates, phosphate, sulfonates, sulfosuccinates, carboxylates, esters, glucoside, amides and mixtures thereof.

12. The system of claim 10 further comprising a second source supplying a secondary agent to the tank.

13. The system of claim 12 wherein the secondary agent is a surfactant.

14. The system of claim 13 wherein the surfactant is selected from a group consisting of: anionic, nonionic, cationic, amphoteric, extended surfactants and blends thereof.

15. The system of claim 12 wherein the source and the second source are configured are operated sequentially.

16. The system of claim 10 wherein the tank includes an agitator.

17. The system of claim 10 wherein the separator is a centrifuge.

18. The system of claim 10 wherein the separator includes a first separator and a second separator.

19. A method of forming a drilling fluid, comprising:

causing water droplets to coalesce from the drilling fluid without reducing a size of particles in the drilling fluid by treating the drilling fluid with a sufficient amount of a demulsifier to cause the water droplets to coalesce, wherein the drilling fluid is an invert emulsion;

separating at least one phase from the treated drilling fluid; and adding to a base fluid at least one of: (i) an oil phase recovered from a treated drilling fluid, and (ii) a functional material recovered from a treated drilling fluid.

20. The method of claim 19 wherein the demulsifier is selected from a group consisting of: ethers, amines, ethoxylates, propoxylates, phosphate, sulfonates, sulfosuccinates, carboxylates, esters, glucoside, amides and mixtures thereof, wherein the volume percentage of demulsifier is between approximately 0.5 to 6.

21. The method of claim 20 further comprising treating the drilling fluid with a surfactant.

22. The method of claim 21 wherein the surfactant is selected from a group consisting of: anionic, nonionic, cationic, amphoteric, extended surfactants and blends thereof.

23. The method of claim 22 wherein the volume percentage of surfactant is between approximately 0.5 to 5.

24. The method of claim 23 wherein the demulsifier and the surfactant are applied sequentially to the drilling fluid.

25. The method of claim 24 wherein the at least one separated phase is one of: (i) a majority oil phase, (ii) a majority water phase, and (iii) a majority solid phase.

26. A method for treating a drilling fluid, comprising:

treating the drilling fluid with a sufficient amount of a demulsifier to cause water droplets to coalesce, wherein a size of particles in the drilling fluid are not reduced to cause the water droplets to coalesce, and wherein the drilling fluid is an invert emulsion; and separating at least one phase from the treated drilling fluid.

27. The method of claim 26 wherein the demulsifier is selected from a group consisting of: ethers, amines, ethoxylates, propoxylates, phosphate, sulfonates, sulfosuccinates, carboxylates, esters, glucoside, amides and mixtures thereof, wherein the volume percentage of demulsifier is between approximately 0.5 to 6.

28. The method of claim 27 further comprising treating the drilling fluid with a surfactant.

29. The method of claim 28 wherein the surfactant is selected from a group consisting of: anionic, nonionic, cationic, amphoteric, extended surfactants and blends thereof.

30. The method of claim 29 wherein the volume percentage of surfactant is between approximately 0.5 to 5.

31. The method of claim 29 wherein the demulsifier and the surfactant are applied sequentially to the drilling fluid.

32. The method of claim 31 wherein the at least one separated phase is one of: (i) a majority oil phase, (ii) a majority water phase, and (iii) a majority solid phase.

* * * * *